US007714496B2

(12) United States Patent
Min et al.

(10) Patent No.: US 7,714,496 B2
(45) Date of Patent: May 11, 2010

(54) FIELD EMISSION DISPLAY DEVICE AND FIELD EMISSION TYPE BACKLIGHT DEVICE HAVING A SEALING STRUCTURE FOR VACUUM EXHAUST

(75) Inventors: Kyong-Won Min, Yongin-si (KR); Byong-Gwon Song, Yongin-si (KR); Yong-Wan Jin, Yongin-si (KR); Deuk-Seok Chung, Yongin-si (KR); Moon-Jin Shin, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 421 days.

(21) Appl. No.: 11/655,153

(22) Filed: Jan. 19, 2007

(65) Prior Publication Data

US 2007/0228928 A1 Oct. 4, 2007

(30) Foreign Application Priority Data

Mar. 31, 2006 (KR) ..... 10-2006-0029806

(51) Int. Cl.
*H01J 1/62* (2006.01)

(52) U.S. Cl. ..... 313/495; 313/496

(58) Field of Classification Search ..... 313/495–497
See application file for complete search history.

(56) References Cited

U.S. PATENT DOCUMENTS

| | | | | |
|---|---|---|---|---|
| 2002/0180373 | A1* | 12/2002 | Park | 315/169.3 |
| 2005/0151461 | A1* | 7/2005 | Tuck et al. | 313/495 |
| 2005/0238853 | A1* | 10/2005 | Kim et al. | 428/192 |

FOREIGN PATENT DOCUMENTS

| | | | |
|---|---|---|---|
| JP | 07-094102 | | 4/1995 |
| JP | 9-106771 | | 4/1997 |
| JP | 1021859 | * | 1/1998 |
| KR | 10-2005-0080273 | | 8/2005 |

OTHER PUBLICATIONS

Office Action from the Korean Intellectual Property Office issued in Applicant's corresponding Korean Patent Application No. 10-2006-0029806 dated Nov. 12, 2007.

Korean Office action corresponding to Korean Patent Application No. 2006-0029806, issued on May 21, 2007.

* cited by examiner

*Primary Examiner*—Bumsuk Won
(74) *Attorney, Agent, or Firm*—Cantor Colburn LLP

(57) ABSTRACT

A field emission display device and a field emission type backlight device having a sealing structure for a vacuum exhaust are provided. The field emission display device is constructed with a cathode substrate and an anode substrate attached to each other and facing each other and a vacuum-exhausted panel space formed therebetween to generated a visual image. Also, the field emission display device is constructed with a sealing member disposed along edges of the cathode substrate and the anode substrate to seal the panel space. At least one inlet exposed to the panel space and an exhaust passage through which the inlet communicates with an outside of the field emission display device are formed in the sealing member. The field emission display device and the field emission type backlight device according to the present invention has a reduced number of manufacturing processes and is suitable for a compact, slim and lightweight design, and a large screen by having the sealing structure for the vacuum exhaust.

25 Claims, 10 Drawing Sheets

FIELD EMISSION DISPLAY DEVICE AND FIELD EMISSION TYPE BACKLIGHT DEVICE HAVING A SEALING STRUCTURE FOR VACUUM EXHAUST

CLAIM OF PRIORITY

This application makes reference to, incorporates the same herein, and claims all benefits accruing under 35 U.S.C. §119 from an application for FIELD EMISSION DISPLAY DEVICE AND FIELD EMISSION TYPE BACKLIGHT DEVICE HAVING A SEALING STRUCTURE FOR VACUUM EXHAUST earlier filed in the Korean Intellectual Property Office on 31 Mar. 2006 and there duly assigned Serial No. 10-2006-00029806.

BACKGROUND OF THE INVENTION

1. Field of the Invention

The present invention relates to a field emission display device and a field emission type backlight device, and more particularly, to a field emission display device and a field emission type backlight device in which a sealing structure for hermetically sealing a vacuum-exhausted panel space is provided as an exhaust path for an impure gas in the panel space.

2. Description of the Related Art

A field emission display device is a self-luminous display device that directly reproduces a full color image by concentrating a high electric field on an emitter that is an electron emission source to induce an emission of cold electrons and directing the electrons accelerated by a voltage difference between a cathode electrode and an anode electrode to collide with red, green, and blue phosphors. A field emission type backlight device is a backlight device that uses the aforementioned field emission, and does not form an image by itself but is mounted on a rear surface of a separate image-forming device, such as a liquid crystal display panel to supply a uniform surface light to the image-forming device.

In the field emission display device and the field emission type backlight device, a cathode substrate and an anode substrate are disposed facing each other and spaced apart from each other. A cathode electrode and a gate electrode crossing the cathode electrode are disposed on the cathode substrate, and the emitter, which is the electron emission source, is disposed at a crossing portion of the cathode electrode and the gate electrode. An anode electrode and a phosphor emitting a light by colliding with the electrons emitted from the electron emission source and accelerated by the anode electrode, are disposed on the anode substrate. The cathode substrate and the anode substrate are attached to each other by a sealant sealing a panel space therebetween. The panel space should be kept in a high vacuum state so as not to disturb the movement of the emitted electrons, and particularly to prevent charged particles from being generated by collision between an impure gas in the panel space and the accelerated electrons. Accordingly, a method for manufacturing the foregoing devices necessarily includes a vacuum exhaust process for sucking an impure gas, such as vapor, from the panel space with a vacuum pump and discharging the impure gas to the outside. According to the related art, an exhaust hole is perforated in a portion adjacent to an edge of the cathode substrate deviating from a display region, and an exhaust pipe is attached to a rear surface of the cathode substrate so as to communicate with the exhaust hole, and then the exhaust pipe is connected to the vacuum pump so that the impure gas in the panel is pumped out until the inside of the panel reaches a vacuum. In attaching the exhaust pipe, a frit paste is coated around the exhaust pipe located at the rear surface of the cathode substrate, and then the cathode substrate is heated to about the melting temperature of the frit paste in a heating chamber.

According to the related art, since the exhaust hole is perforated and the exhaust pipe is attached prior to the exhaust process, the number of processes increases. Also, when fine particles generated during the perforation of the exhaust hole through the panel, the particles may obstruct normal operation and result in a defective product. In addition, since the exhaust pipe is attached to protrude from a rear surface of the cathode substrate, the presence of the exhaust pipe restricts the amenability to reduce the thickness of the display device and to thereby manufacturing a thin type display device; moreover, the rear space of the display device occupied by the exhaust pipe is not suitable for use for another purpose, thus concomitantly decreasing space utilization.

Meanwhile, a portion adjacent to the edge of the cathode substrate is a region provided to perforate the exhaust hole, and thus cannot be used as an effective display region where a visual video image is displayed. Therefore, according to the related art, an ineffective region is necessarily generated due to the necessity for a perforation of the exhaust hole.

An impure gas generally remains in the panel space after the vacuum exhaust process. Therefore, a getter material that reacts well with an impure gas is injected into the panel, and is activated. The activated getter adsorbs the impure gas in the panel, and induces an internal space to a high vacuous state. According to the related art, the getter is dispersedly disposed in the exhaust pipe or an empty space in the panel except for a display region where electrodes are arranged. At this point, since the getter is exposed to an emission space of electron beams, a portion of electrons emitted from an emitter may be distorted in an unexpected path by interacting with the getter material. Also, since the getter after absorbing the impure gas becomes useless but still remains in the panel, a blank space for carrying the getter is separately required, and a separate supporting structure for fixedly supporting the getter is required. Consequently, according to the related art, the panel structure is complicated, and the degree of freedom of the design is restricted in the intensively designed panel structure.

SUMMARY OF THE INVENTION

It is therefore an object of the present invention to provide an improved field emission display device and an improved field emission type backlight device.

It is another object to provide a field emission display device and a field emission type backlight device that can reduce the number of processes by providing a single structure for both exhaust and sealing functions.

It is yet another object to provide a field emission display device and a field emission type backlight device that increases the space utilization of the rear of a panel and is advantageous for the manufacture of a compact, slim and lightweight structure.

It is still another object to provide a field emission display device and a field emission type backlight device suitable for a large screen display by eliminating an ineffective region for exhaust of impure gases.

It is a further object to provide a field emission display device and a field emission type backlight device having a simplified internal panel structure by eliminating a separate supporting structure for mounting a getter.

According to an aspect of the present invention, a field emission display device is provided with a cathode substrate and an anode substrate disposed to face each other and a vacuum-exhausted panel space is interposed between the cathode substrate and the anode substrate to generate a variable, visual, video images. The field emission display device is constructed with a sealing member disposed along the edges of the cathode substrate and the anode substrate to seal the panel space. The sealing member is constructed with at least one inlet exposed to the panel space and an exhaust passage through which the inlet communicates with an outside of the field emission display device.

According to another aspect of the present invention, a field emission type backlight device is provided with a cathode substrate and an anode substrate disposed to face each other and a vacuum-exhausted panel space is interposed between the cathode substrate and the anode substrate to provide uniform light to a video image forming panel. The field emission type backlight device is constructed with a sealing member disposed along the edges of the cathode substrate and the anode substrate to seal the panel space. The sealing member is constructed with at least one inlet exposed to the panel space and an exhaust passage through which the inlet communicates with an outside of the backlight device.

The sealing member may have a rectangular frame shape, and may include a pair of frit bars constituting the longer sides of the sealing member and a pair of exhaust tubes in which the exhaust passage is formed constituting the shorter sides of the sealing member.

The inlet may include a plurality of holes formed at intervals in a length direction taken along the exhaust tubes or one hole may be formed in an elongated shape in a length direction taken along the exhaust tubes.

Each of the exhaust tubes may be made from a hollow member having a square cross section and having a first surface facing the anode substrate and a second surface facing the cathode substrate, or each of the exhaust tubes may be made from a cylindrical hollow member. Each of the frit bars may be made from a solid member having a square cross section. Also, the flit bars and the exhaust tubes are made from a glass material.

The frit bars and the exhaust tubes may be attached to each other through heat fusion of a frit paste interposed therebetween.

A frit paste to attach the substrates through a heat fusion may be formed in upper and lower surfaces of the sealing member respectively facing the cathode substrate and the anode substrate.

A getter may be injected into the sealing member to adsorb an impure gas and disposed on the exhaust passage of the impure gas.

BRIEF DESCRIPTION OF THE DRAWINGS

A more complete appreciation of the invention and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
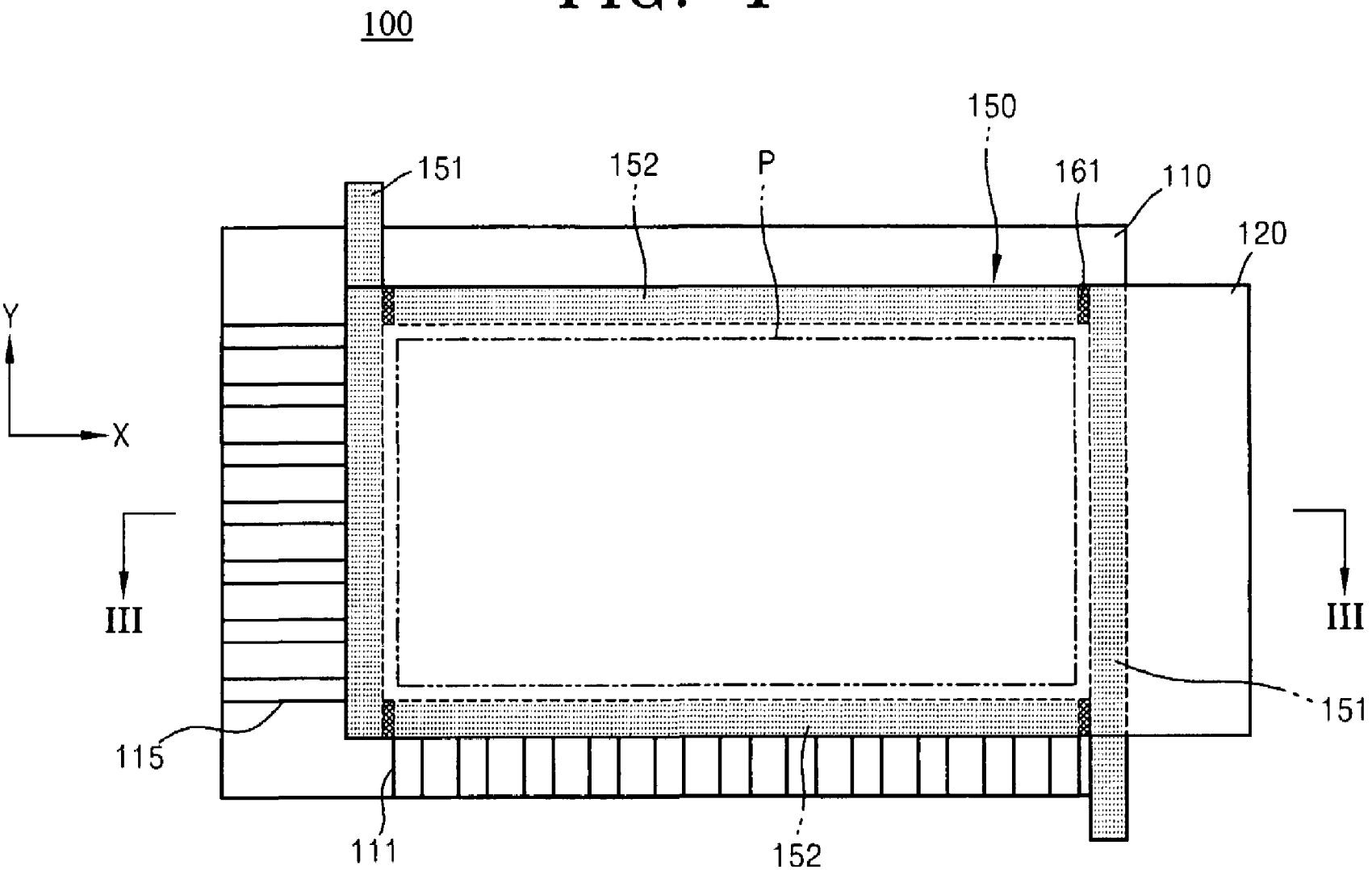
FIG. 1 is a plan view of a field emission display device constructed as an embodiment of the principles of the present invention.

The present invention will now be described more fully with reference to the accompanying drawings, in which exemplary embodiments of the invention are shown. FIG. 1 is a plan view of a field emission display device according to an embodiment of the present invention. Referring to FIG. 1, field emission display device 100 is constructed with an anode substrate 120 and a cathode substrate 110 overlapping each other. Anode substrate 120 and cathode substrate 110 are attached to each other by a sealing member 150 formed along the entirety of the peripheral edges of anode substrate 120 and cathode substrate 110 to effectively form a closed rectangular shape. Sealing member 150 forms a roughly rectangular frame. An inner region surrounded by sealing member 150 serves as a display region P emitting light to display an visual image. Sealing member 150 may be constructed with a pair of diagonally opposite exhaust tubes 151 and a pair of frit bars 152 formed parallel to each other in the right and left and the upper and lower sides, respectively, of display region P. Exhaust tubes 151 and frit bars 152 may be attached to each other by a heat fusion of a frit paste 161 interposed therebetween.

A plurality of cathode electrodes 111 and gate electrodes 115 are disposed in display region P to be supplied with controlled signals from external circuit substrates, to extend to an outside of display region P. A terminal region (not shown) is formed outside display region P to electrically connect end portions of cathode electrodes 111 and gate electrodes 115 to the external circuit substrates.

Figure 2:
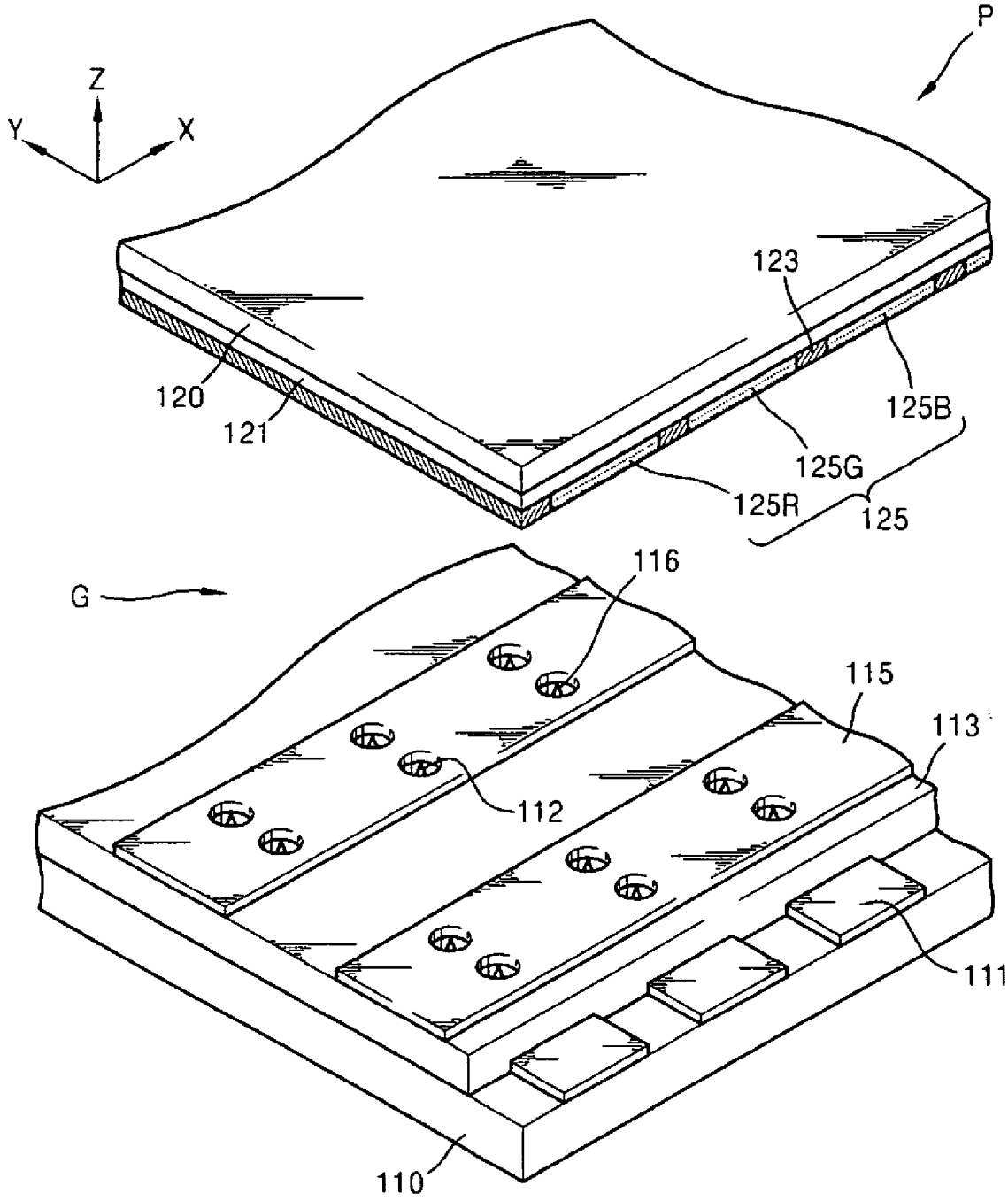
FIG. 2 is an exploded oblique view of a display region of the field emission display device of FIG. 1, constructed as an embodiment of the principles of the present invention.
Figure 3:
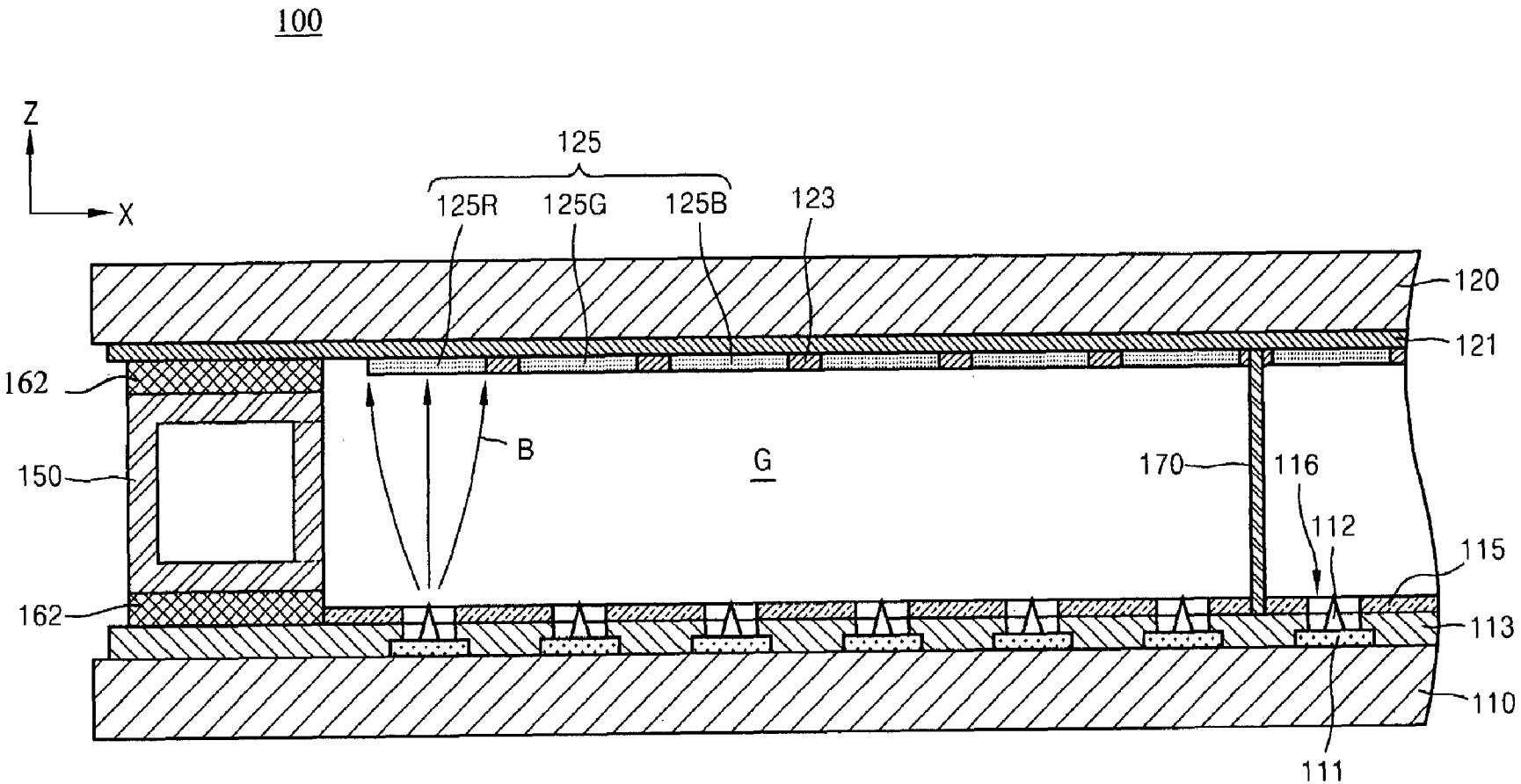
FIG. 3 is a cross-sectional view of the field emission display device of FIG. 1 taken along line III-III, constructed as an embodiment of the principles of the present invention.

FIG. 2 is an exploded oblique view of display region P of field emission display device 100 of FIG. 1, constructed as an embodiment of the principles of the present invention. FIG. 3 is a cross-sectional view of field emission display device 100 of FIG. 1 taken along line III-III, as an embodiment of the principles of the present invention. Referring to FIG. 2, cathode electrodes 111 are formed in a stripe pattern at regular intervals in the y direction and a dielectric layer 113 covering cathode electrodes 111 is formed on cathode substrate 110. Gate electrodes 115 are formed in a stripe pattern in the x direction crossing cathode electrodes 111 on dielectric layer 113. A plurality of emitters 112 protruding from cathode electrodes 111 are formed in a crossing region where cathode electrodes 111 and gate electrodes 115 cross each other, and are connected to cathode electrodes 111 to be provided with an electrical current. A plurality of emitter holes 116 are formed in gate electrodes 115 to expose the sharp, conical tips of emitters 112. Gate electrodes 115 and the tips of emitter 112 are spaced from each other by distances on a submicron scale, and a number of electrons are emitted from emitters 112 by a high electric field formed between gate electrodes 115 and emitters 112. An anode electrode 121 is disposed on anode substrate 120, and a bias voltage is applied to anode electrode 121 to accelerate the electrons emitted from emitters 112. Anode electrode 121 is a common electrode forming the same voltage for an entire display region, and may be made from a plane electrode, as illustrated in FIG. 2. Anode electrode 121 may be made from an optically transparent electrode material, for example, indium-tin-oxide (ITO), etc., considering an optical extraction efficiency. Anode electrode 121 is covered with a phosphor layer 125, and phosphor layer 125 may include a red phosphor layer 125R, a green phosphor layer 125G, and a blue phosphor layer 125B. Phosphor layer 125 is transited to an excited state by a collision with an electron beam B, and then emits a display light having inherent wavelengths depending on types of the phosphor while falling to a ground state. Phosphor layer 125 having different emitting colors is divided by a black matrix 123 having a pattern. Black matrix 123 has a dark color and a high light absorbing efficiency to maintain a high contrast ratio by absorbing an external light. Black matrix 123 also prevents color mixing due to the optical interference between neighboring emitting colors. Referring to FIG. 3, a panel space G maintaining a high vacuum of, for example, more than $10^{-6}$ Torr, is formed between anode substrate 120 and cathode substrate 110. Panel space G is maintained at a set height by a plurality of spacers 170 disposed therein.

In order to drive field emission display device 100, a negative (−) voltage is applied to cathode electrodes 111, and a positive (+) voltage is applied to anode electrodes 121. At this point, electron beam B is emitted from the tip of emitters 112 by a high electric field formed by gate electrodes 115 and anode electrodes 121, and the emitted electron beam B collides with the corresponding phosphor layer 125, and thus light is emitted.

Sealing member 150 is disposed between anode substrate 120 and cathode substrate 110 to seal panel space G. Frit paste 162 is formed on the upper and lower surfaces of sealing member 150 to attach anode substrate 120 and cathode substrate 110 to sealing member 150, and a space between sealing member 150 and cathode substrate 110 and anode substrate 120 is sealed by the heat fusion of flit paste 162.

Figure 4:
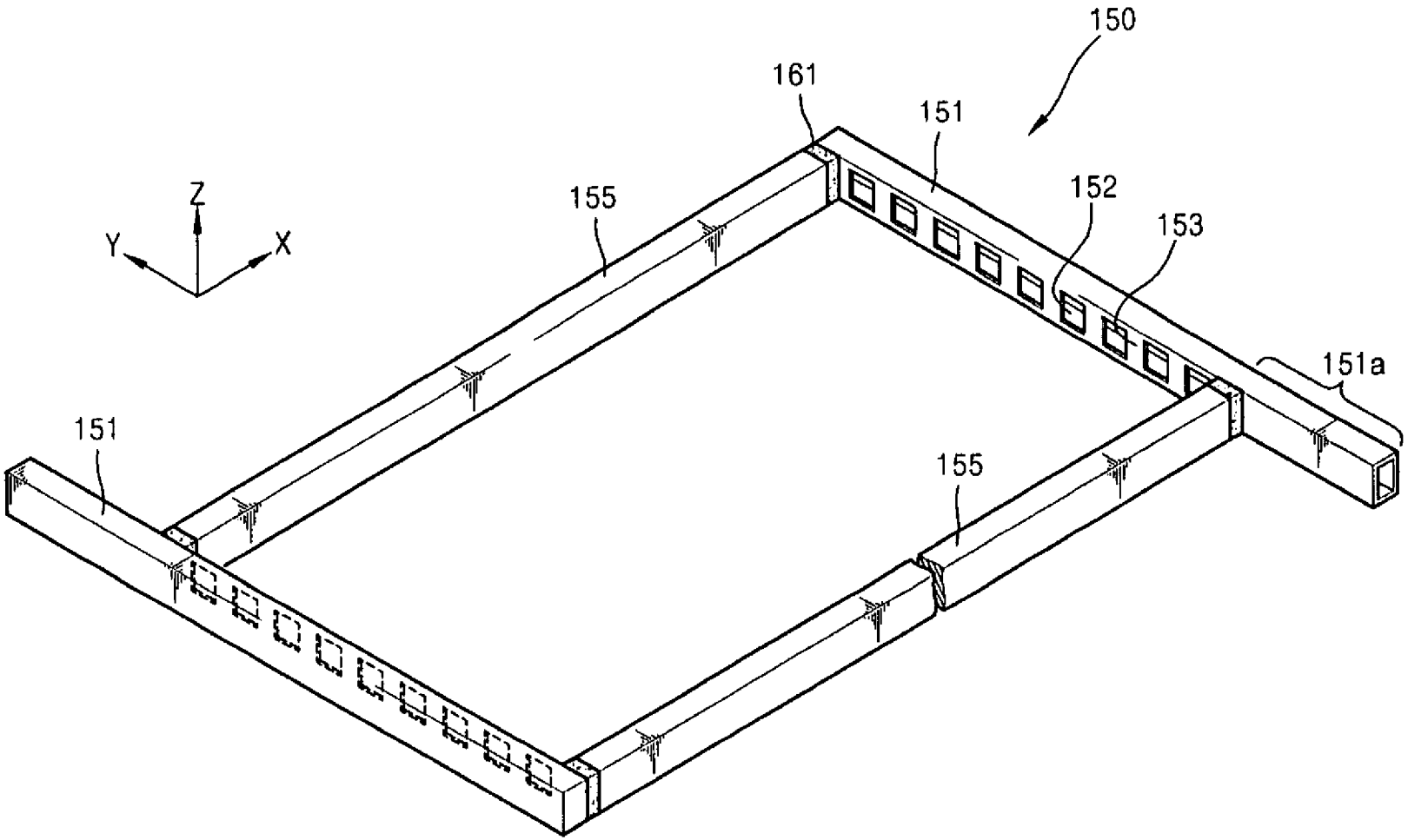
FIG. 4 is an oblique view of a sealing member shown in FIG. 3, constructed as an embodiment of the principles of the present invention.
Figure 5:
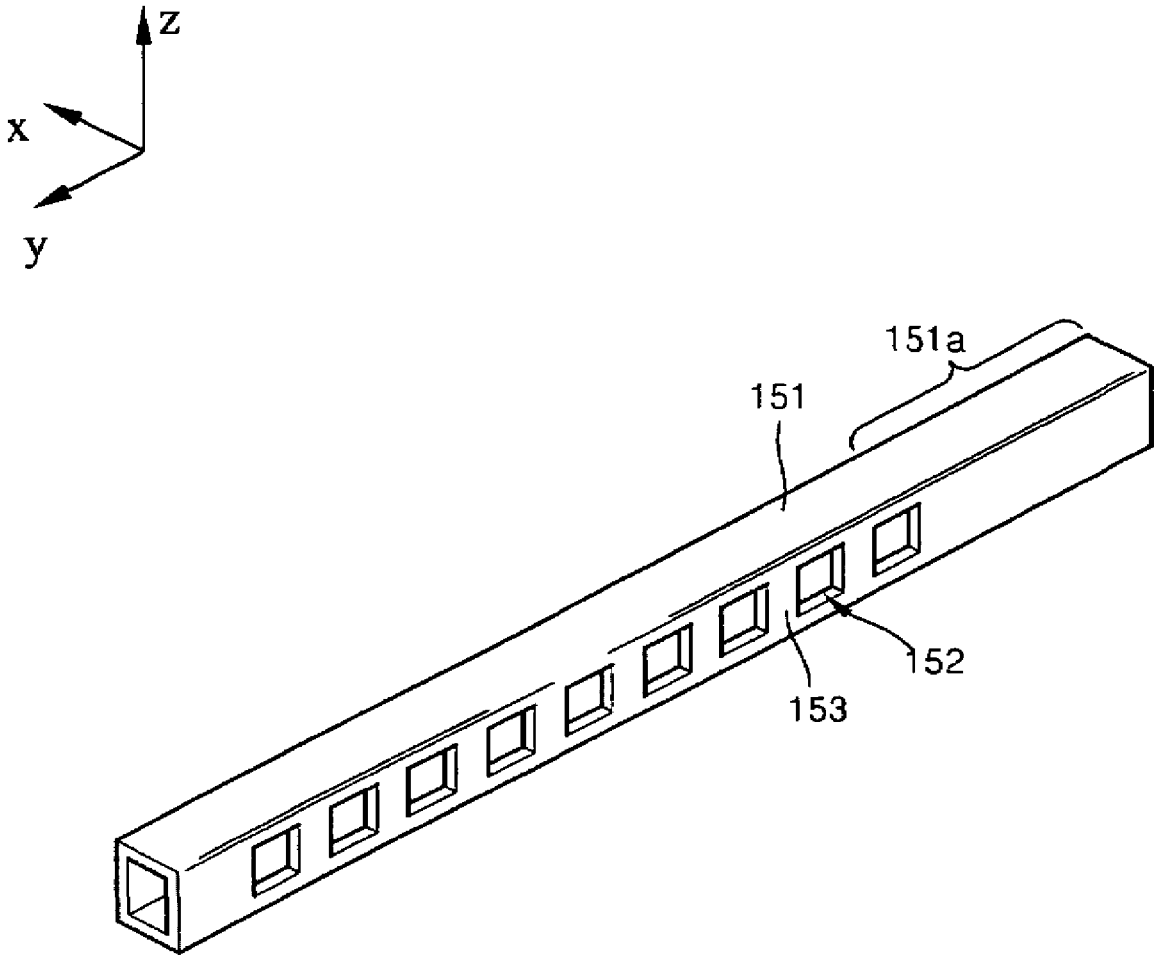
FIG. 5 is an oblique view of an exhaust tube included in the sealing member shown in FIG. 4, constructed as an embodiment of the principles of the present invention.

FIG. 4 is an oblique view of sealing member 150 shown in FIG. 3 as an embodiment of the principles of the present invention and FIG. 5 is an oblique view of an exhaust tube 151 included in sealing member 150 as an embodiment of the principles of the present invention. Sealing member 150 forms a roughly rectangular frame, and is constructed with frit bars 155 constituting long sides of sealing member 150 extending in a horizontal direction (the x direction) and exhaust tubes 151 constituting short sides of sealing member 150 extending in a vertical direction (the y direction). Frit bars 155 seal a space between cathode substrate 110 and anode substrate 120 and support cathode substrate 110 and anode substrate 120 to maintain a regular interval between cathode substrate 110 and anode substrate 120. Frit bars 155 may be made from a solid member having a square cross section, as illustrated in FIG. 4.

Exhaust tubes 151 serve as exhaust passages for discharging an impure gas in panel space G to the outside during the exhaust process performed in a manufacturing process of the display device. For this purpose, each of exhaust tubes 151 is made from a hollow member forming a flowing passage to guide the impure gas. At least one inlet 152 is formed in a side wall of each of exhaust tubes 151 facing toward panel space G. For example, a plurality of inlets 152 may be formed at intervals in a length direction of exhaust tubes 151 (in the y direction). The impure gas in panel space G is forced to enter exhaust tubes 151 through inlets 152 by a negative pressure formed by a vacuum pump, and is discharged to the outside via exhaust tubes 151. Exhaust tubes 151 support a space between anode substrate 120 and cathode substrate 110 with frit bars 155. For example, a supporting strength is required to withstand a pressure applied in a process of pressurizing and attaching cathode substrate 110 and anode substrate 120 to each other or to withstand a pressure difference between the inside of panel space G which is maintained in a vacuum state and the external atmospheric pressure. At this point, since exhaust tubes 151 are supported in the vertical direction (z direction) by sidewalls 153 between inlets 152, a concrete factor such as a number or a length of inlets 152 may be determined in a range that secures the minimum supporting strength. Also, if inlets 152 are formed in an end portion 151*a* of exhaust tubes 151 extending outside panel space G, the vacuum pressure of the vacuum pump cannot be delivered to panel space G, that is, the pressure is reduced. Therefore, inlets 152 should not be formed in end portions 151*a* of exhaust tubes 151. Exhaust tubes 151 and frit bars 155 may be made from a glass material.

Figure 6:
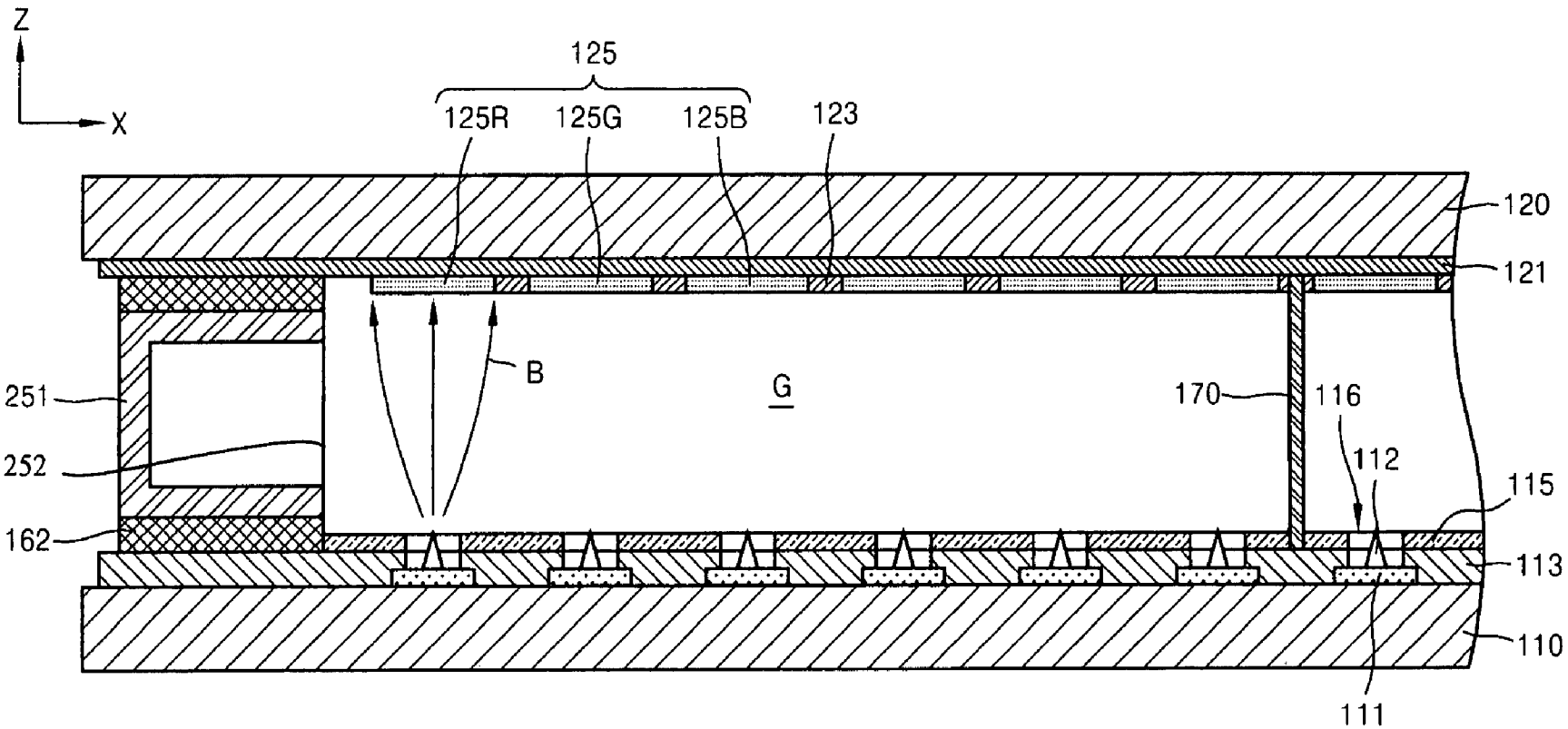
FIG. 6 is a vertical sectional view of a field emission display device constructed as another embodiment of the principles of the present invention.
Figure 7:
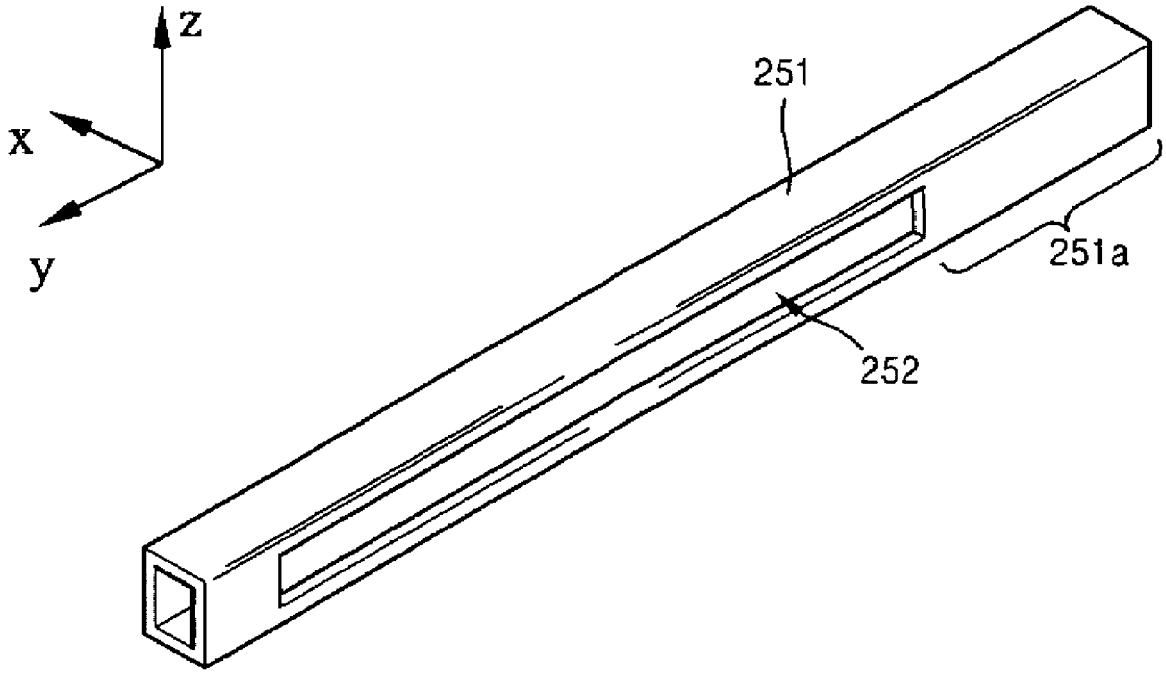
FIG. 7 is an oblique view of an exhaust tube included in the field emission display device of FIG. 6, constructed as another embodiment of the principles of the present invention.

FIG. 6 is a vertical cross-sectional view of a field emission display device 101 constructed as another embodiment of the principles of the present invention, and FIG. 7 is an oblique view of an exhaust tube 251 included in field emission display 101 device illustrated in FIG. 6, according to another embodiment of the principles of the present invention. Referring to FIG. 7, an inlet 252 is formed in a side wall of exhaust tube 251 facing toward panel space G and is elongated in a length direction of exhaust tube 251 (y direction). At this point, if inlet 252 is formed in an end portion 251*a* of exhaust tube 251 extending outside a panel space, sucking pressure may be lost, and thus 14 end portion 251*a* of exhaust tube 251 may have a closed cross section.

Figure 8:
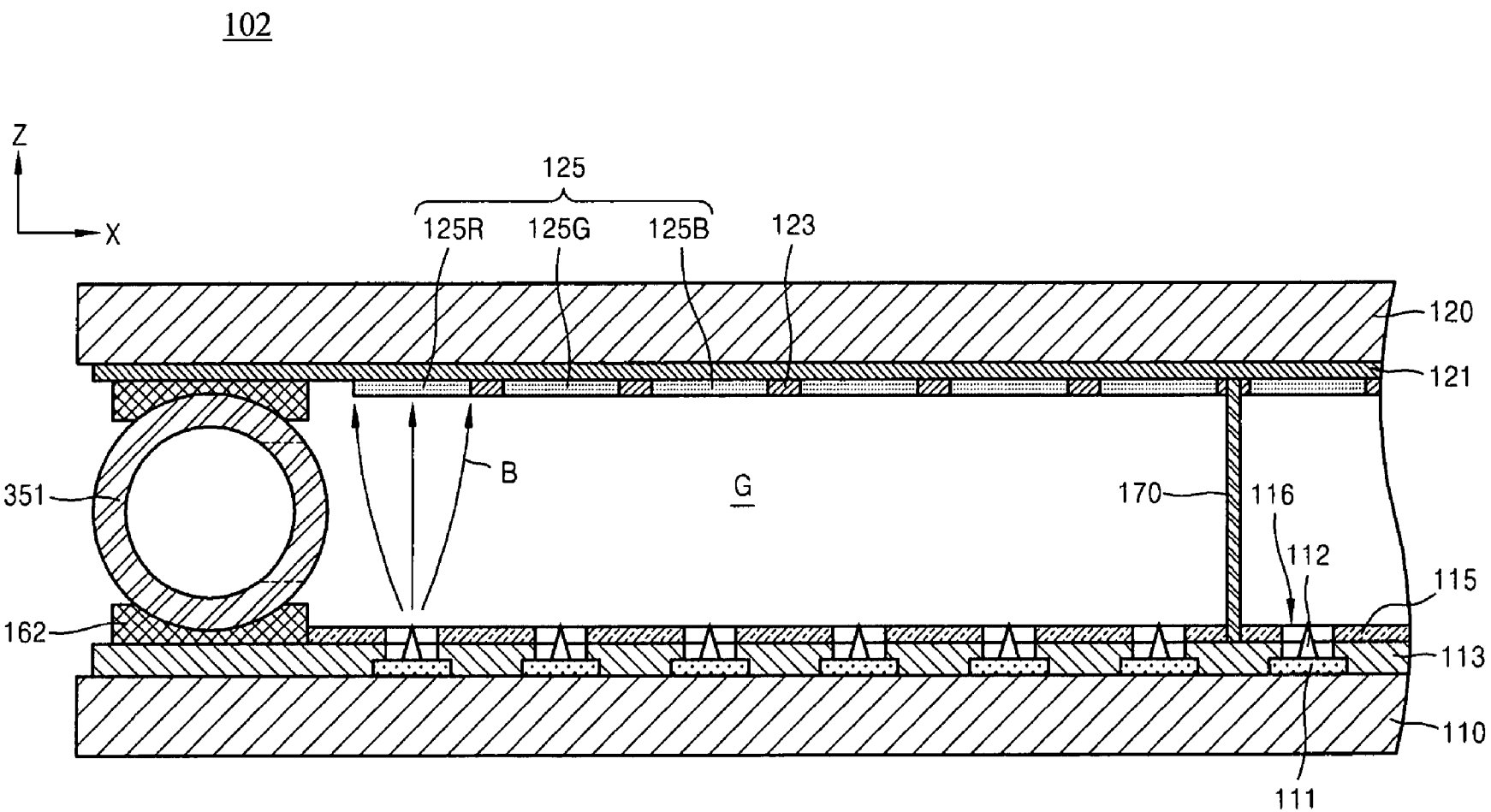
FIG. 8 is a vertical cross-sectional view of a field emission display device constructed as still another embodiment of the principles of the present invention.
Figure 9:
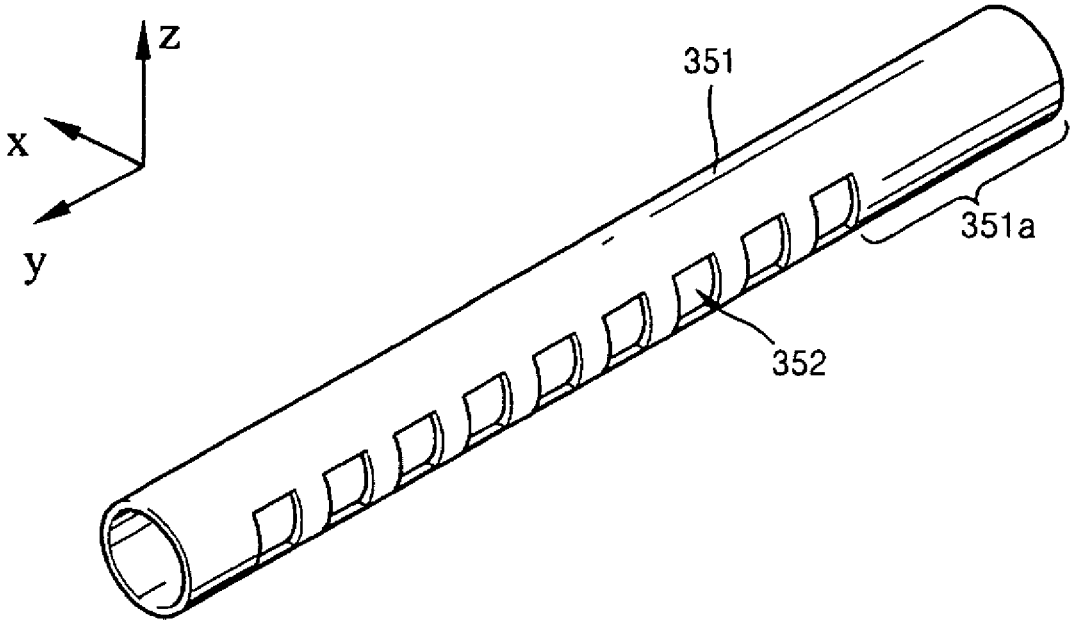
FIG. 9 is an oblique view of an exhaust tube included in the field emission display device of FIG. 8, constructed as an embodiment of the principles of the present invention.
Figure 10:
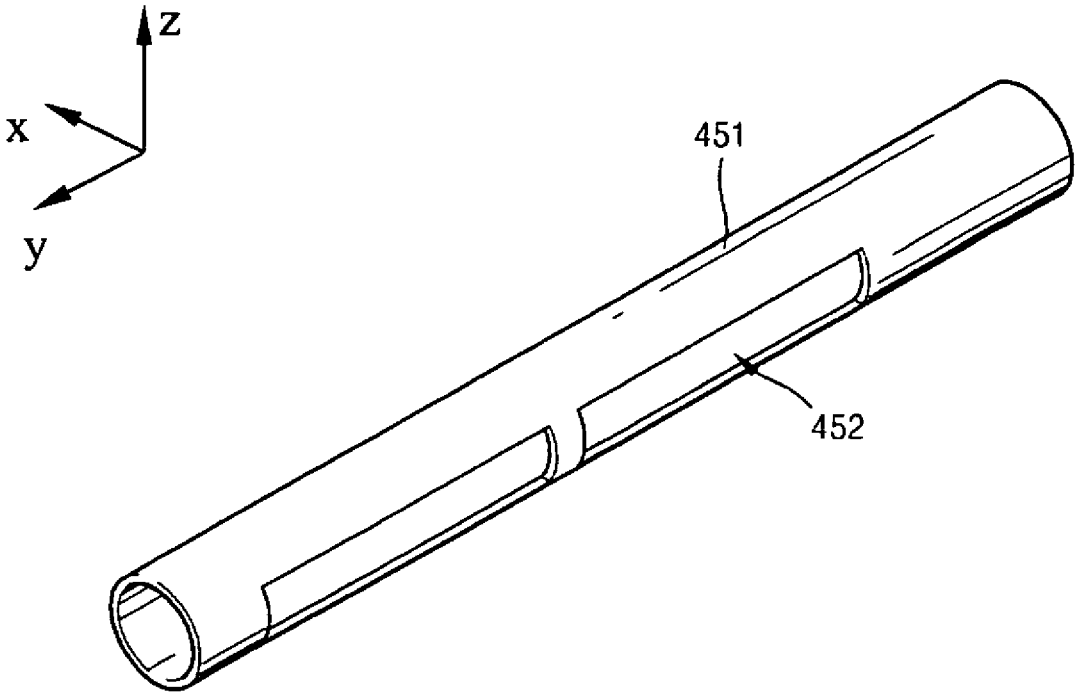
FIG. 10 is an oblique view of an exhaust tube included in the field emission display device of FIG. 8, constructed as another embodiment of the principles of the present invention.

FIG. 8 is a vertical cross-sectional view of a field emission display device 102 constructed as still another embodiment of the principles of the present invention, and FIG. 9 is a perspective view of an exhaust tube included in field emission display device 102 of FIG. 8 according to an embodiment of the principles of the present invention. Exhaust tube 351 is made from a cylindrically hollow member. A fitting gasket (not shown) connected to a vacuum pump (not shown) is fitted to an end portion 351*a* of exhaust tube 351 extending outside a panel space G. The fitting gasket generally has a cylindrical shape corresponding to a pipe. Accordingly, exhaust tube 351 may be connected to the vacuum pump through a general fitting gasket having an appropriately sized diameter, and thus the inconvenience of preparing a special type of fitting gasket may be eliminated. A plurality of inlets 352 for an impure gas may be formed in a side wall of exhaust tube 351 facing toward panel space G at set intervals in a length direction of exhaust tube 351 (in the y direction). FIG. 10 is an oblique view of an exhaust tube included in field emission display device 102 of FIG. 8 according to another embodiment of the present invention. Referring to FIG. 10, exhaust tube 451 has a cylindrical shape and has two inlets 452 elongated in a length direction of the exhaust tube (y direction). At least more than one inlet may be formed in the exhaust tube of the present invention, and the number of inlets is not limited. Also, as long as the exhaust tube includes a flowing passage formed therein to guide the impure gas, its cross section is not limited to the square shape shown in FIG. 5 or the cylindrical shape shown in FIGS. 9 and 10, and may be variously changed.

Figure 11:
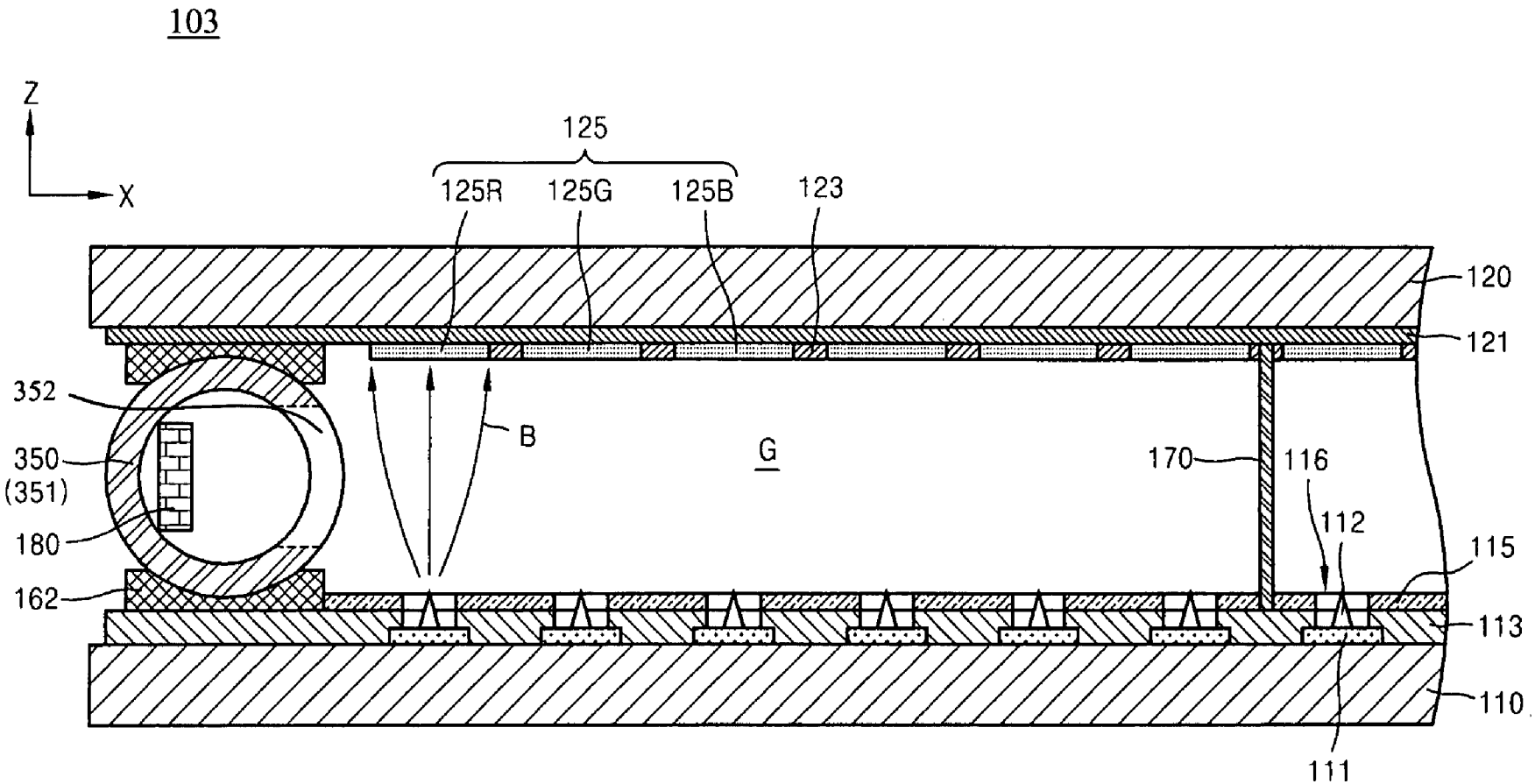
FIG. 11 is a vertical cross-sectional view of a field emission display constructed as a further embodiment of the principles of the present invention.

FIG. 11 is a vertical cross-sectional view of a field emission display device 103 according to a further embodiment of the present invention. Field emission display device 103 illustrated in FIG. 11 is constructed an anode substrate 120 and a cathode substrate 110 disposed facing each other, and a sealing member 350 sealing a panel space G between cathode substrate 110 and cathode substrate 120 and maintaining a vacuum state. Sealing member 350 is constructed with an exhaust tube 351 to exhaust an impure gas in panel space G. In particular, in this embodiment, a getter 180 is disposed inside exhaust tube 351. Getter 180 includes ingredients having an excellent absorption of an impure gas, and may include, for example, more than one kind of metal oxide powder selected from W, Ti, Zr, Al, V, and Fe as a chief ingredient, but is not limited thereto. Getter 180 induces panel space G to a high vacuum state by absorbing and removing the impure gas remaining in panel space G after an exhaust process. In a getter-activation process after the exhaust process, getter 180 may be activated for example, by injecting getter 180 into exhaust tube 351, and applying a voltage to getter 180 from an external power source or irradiating a laser from an external light source.

In the related art, getter 180 is exposed as it is to an emission space of an electron beam B, and a structure for isolating getter 180 from the emission space is not provided. As a result, stability of electron beam B decreased, for example, a flow of electrons inside the emission space was distorted by getter 180. According to an embodiment of the principles of the present invention, getter 180 injected into exhaust tube 351 is structurally isolated from the emission space of electron beam B, thereby completely preventing an interaction between getter 180 and the emitted electrons, and the distortion of a flow of the electrons, and inducing a stable flow of the electrons. Also, in the related art, a separate supporting structure to fixedly support getter 180 is required, but according to an embodiment of the principles of the present invention, exhaust tube 350 also serves as a supporting structure for getter 180, and thus a convenient design is obtained.

The present invention is described in relation to a field emission display device, but technical features of the present invention are not limited to a display device displaying a visual image, and can be applied to a field emission type backlight device having a substantially similar structure. For example, in a field emission type backlight device of the present invention, a white phosphor layer emitting white light of multiple wavelengths may be included, instead of red, green, and blue phosphor layers emitting different colors arranged in an array shape in the anode substrate. In another field emission type backlight device, phosphors of different emitting colors are arranged in an array shape, and a light diffusion film for mixing multi-color lights of different wavelength ranges may be disposed in the front of the field emission type backlight device.

The field emission display device and the field emission type backlight device of the present invention can achieve the following effects.

The field emission display device and the field emission type backlight device have increased space utilization for a rear space of the panel and are suitable for a compact, slim and lightweight design. Specifically, since an exhaust pipe protruding from rear surface of the panel as in the related art is not required, the requirement for a rear space is eliminated, thereby providing a compact, slim and lightweight display device. Also, a rear space may be utilized as a mounting space of electrical equipment for improving performance and for increasing the space utilization.

Since the processing and the time required for a perforation of the exhaust hole and an attachment of the exhaust pipe are reduced, the manufacturing cost decreases. Also, damages or defects of the panel that can be generated during the perforation of the exhaust hole or the attachment of the exhaust pipe, can be eliminated.

Since an invalid region wasted to form the exhaust hole in the related art decreases, a larger valid pixel region is obtained for a panel of the same size.

Since the getter material for absorption of the remaining impure gas is provided in the sealing member, the supporting structure separately disposed in the panel to mount the getter material is eliminated, the inner structure of the intensively designed panel is simplified, and the flexibility of the panel design is improved. Also, according to the present invention, since the getter material is disposed in the sealing structure to be isolated from the emission space of the electron beam, the stability of the electron beam is improved.

Since the sealing structure for the vacuum exhaust is provided, compared with the related art where the exhaust structure and the sealing structure are separately provided, the number of processes can be largely reduced.

In the related art, the size of the exhaust hole is restricted to minimize a wasted pixel region, and thus a time delay is generated in the vacuum exhaust process. However, since the size of the exhaust passage is freely increased in the present invention, the vacuum exhaust is rapidly performed and the manufacturing unit cost is reduced.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A field emission display device, comprising:

a cathode substrate and an anode substrate disposed to face each other and form an interposed vacuum-exhausted panel space to form a visual image; and a sealing member disposed continuously along edges of the cathode substrate and the anode substrate to seal the panel space, wherein the sea link member comprises an exhaust tube disposed along at least one of the edges and a frit bar disposed along at least one of the edges on which the exhaust tube is not disposed, wherein the exhaust tube comprises at least one inlet exposed to the panel space and an exhaust passage through which the inlet communicates with an outside of the panel space of the field emission display device, wherein the exhaust tube and the frit bar constitute an exterior wall of the panel space.

2. The field emission display device of claim 1, wherein the sealing member has a rectangular frame shape and comprises a pair of fit bars constituting longer sides of the sealing member, and a pair of exhaust tubes constituting shorter sides of the sealing member.

3. The field emission display device of claim 2, with the inlet comprising a plurality of holes formed at intervals in a length direction of the exhaust tubes.

4. The field emission display device of claim 2, with the inlet comprising one hole formed along an elongated shape in a length direction of the exhaust tubes.

5. The field emission display device of claim 2, with each of the exhaust tubes being made from a hollow member having a square cross section and having a first surface facing the anode substrate and a second surface facing the cathode substrate.

6. The field emission display device of claim 2, with each of the exhaust tubes being made from a cylindrical hollow member.

7. The field emission display device of claim 2, with each of the fit bars being made from a solid member having a square cross section.

8. The field emission display device of claim 2, with the fit bars and the exhaust tubes being made from a glass material.

9. The field emission display device of claim 2, with the fit bars and the exhaust tubes being attached to each other through heat fusion of a fit paste interposed therebetween.

10. The field emission display device of claim 2, with each of the exhaust tubes comprising at least one end portion extending outside the cathode substrate and the anode substrate.

11. The field emission display device of claim 1, further comprising a fit paste to attach the substrates through heat fusion, with the fit paste being formed on upper and lower surfaces of the sealing member facing the cathode substrate and the anode substrate.

12. The field emission display device of claim 1, further comprising a getter being injected into the exhaust tube to adsorb an impure gas.

13. The field emission display device of claim 12, with the getter being disposed on the exhaust passage of the impure gas.

14. The field emission display device of claim 1, with the cathode substrate comprising a cathode electrode arranged in a stripe pattern in a first direction and a gate electrode extending in a second direction crossing the cathode electrode, and an emitter disposed as an electron emission source in a crossing region of the cathode electrode and the gate electrode, and the anode substrate comprising an anode electrode for accelerating electrons emitted from the emitter, and red, green, and blue phosphor layers emitting a light by colliding with the accelerated electrons, the anode electrode and the red, green and blue phosphor layers being disposed in a array.

15. A field emission type backlight device, comprising:

a cathode substrate and an anode substrate disposed to face each other and form an interposed vacuum-exhausted panel space to provide uniform light to an image forming panel; and a sealing member disposed contiguously along a plurality of edges of the cathode substrate and the anode substrate to seal the panel space, wherein the sealing member comprises an exhaust tube disposed along at least one of the edges and a frit bar disposed along at least one of the edges on which the exhaust tube is not disposed, wherein the exhaust tube comprises at least one inlet exposed to the panel space and an exhaust passage through which the inlet communicates with an environment exterior to the backlight device, and wherein the exhaust tube and the flit bar constitute an exterior wall of the panel space.

16. The field emission type backlight device of claim 15, with the sealing member having a rectangular frame shape, and comprising a pair of fit bars constituting longer sides of the sealing member and a pair of exhaust tubes through which the exhaust passage is formed constituting shorter sides of the sealing member.

17. The field emission type backlight device of claim 16, with the inlet comprising a plurality of holes formed at intervals in a length direction of the exhaust tubes.

18. The field emission type backlight device of claim 16, with the inlet comprising a hole formed in an elongated shape along a length direction of the exhaust tubes.

19. The field emission type backlight device of claim 16, with each of the exhaust tubes being made from a hollow member having a square cross section having a first surface facing the anode substrate and a second surface facing the cathode substrate.

20. The field emission type backlight device of claim 16, with each of the exhaust tubes being made from a cylindrical hollow member.

21. The field emission type backlight device of claim 16, with each of the fit bars being made from a solid member having a square cross section.

22. The field emission type backlight device of claim 15, further comprising a fit paste to attach the cathode substrate and the anode substrate through heat fusion, with the fit paste being formed in upper and lower surfaces of the sealing member facing the cathode substrate and the anode substrate.

23. The field emission type backlight device of claim 15, further comprising a getter injected into the exhaust tube to adsorb an impure gas.

24. The field emission type backlight device of claim 23, with the getter being disposed on an exhaust passage of the impure gas.

25. The field emission type backlight device of claim 15, with the cathode substrate comprising a cathode electrode arranged in a stripe pattern in a first direction and a gate electrode extending in a second direction crossing the cathode electrode, and an emitter disposed as an electron emission source in a crossing region of the cathode electrode and the gate electrode, and the anode substrate comprises an anode electrode for accelerating electrons emitted from the emitter and phosphor layer emitting a light by colliding with the accelerated electrons.

* * * * *